US012796776B2

(12) United States Patent
Murphy

(10) Patent No.: US 12,796,776 B2
(45) Date of Patent: Nov. 17, 2026

(54) HIGH-HEELED SHOES AND OUTSOLE FOR SAME

(71) Applicant: Sandra Powers Murphy, Wayland, MA (US)

(72) Inventor: Sandra Powers Murphy, Wayland, MA (US)

( * ) Notice: Subject to any disclaimer, the term of this patent is extended or adjusted under 35 U.S.C. 154(b) by 0 days.

(21) Appl. No.: 18/849,986

(22) PCT Filed: Mar. 28, 2023

(86) PCT No.: PCT/US2023/065066
§ 371 (c)(1),
(2) Date: Sep. 23, 2024

(87) PCT Pub. No.: WO2023/192879
PCT Pub. Date: Oct. 5, 2023

(65) Prior Publication Data

US 2025/0241405 A1 Jul. 31, 2025

Related U.S. Application Data

(60) Provisional application No. 63/325,120, filed on Mar. 29, 2022.

(51) Int. Cl.
*A43B 13/22* (2006.01)
*A43B 13/37* (2006.01)

(52) U.S. Cl.
CPC ..... *A43B 13/223* (2013.01); *A43B 13/37* (2013.01)

(58) Field of Classification Search
CPC ..... A43B 13/223; A43B 13/26; A43B 13/226
See application file for complete search history.

(56) References Cited

U.S. PATENT DOCUMENTS 429,480 A 6/1890 Robinson et al.
581,146 A 4/1897 Young
(Continued)

FOREIGN PATENT DOCUMENTS

CN 202262491 U 6/2012
CN 202774416 U 3/2013
(Continued)

OTHER PUBLICATIONS

International Search Report and Written Opinion received for PCT Patent Application No. PCT/US2023/065066, mailed on Jul. 21, 2023, 8 pages.
(Continued)

*Primary Examiner* — Megan E Lynch
(74) *Attorney, Agent, or Firm* — Adler Pollock & Sheehan P.C.

(57) ABSTRACT

A shoe and an outsole therefor. The shoe has a high heel and upper body. The shoe outsole engages the upper body and includes an inside surface and an outside surface opposite the inside surface. The outside surface has a posterior portion, an anterior portion continuous with the posterior portion and an integral raised platform formed on the anterior portion. The integral raised platform includes an etched pattern on a surface thereof, while the inside surface includes a textured portion. The shoe includes at least one side edge, and the integral raised platform is disposed a first distance therefrom. The integral raised platform has a first height of 4.0 mm, and tapers to a second height proximate a toe edge of the shoe, the second height being less than the first height. Insoles for the shoe are also disclosed.

2 Claims, 17 Drawing Sheets

(56) References Cited

U.S. PATENT DOCUMENTS 953,077 A 3/1910 Warner
1,564,060 A 12/1925 Grosjean
D78,191 S 4/1929 Bush
D79,934 S 11/1929 Paterson
1,781,715 A 11/1930 Blakely
D90,057 S 5/1933 Cleef
D90,356 S 7/1933 Brockman
1,932,658 A 10/1933 Goodfriend
2,003,961 A 6/1935 Vittengl
D106,676 S 10/1937 Richards
D115,606 S 7/1939 Bernstein
D119,266 S 3/1940 Johnson
2,391,789 A 12/1945 Lumbard
D188,932 S 10/1960 Cleghorne
D196,491 S 10/1963 Papoutsy
3,143,812 A 8/1964 Ernst
D204,596 S 5/1966 Anson
3,412,487 A 11/1968 Diamant
3,742,627 A * 7/1973 Schneider ..... A43B 7/22 36/71
4,400,893 A * 8/1983 Musci ..... A43B 13/34 12/142 J
D307,817 S 5/1990 Schneider
4,930,232 A 6/1990 Engle
5,203,792 A 4/1993 Kaiser
D335,572 S 5/1993 Peterson
D342,375 S 12/1993 Nichol, Jr.
D346,480 S 5/1994 Davidson
5,311,676 A 5/1994 Hughes et al.
D348,148 S 6/1994 Limauro
5,435,077 A * 7/1995 Pyle ..... A43B 13/00 36/76 R
D366,139 S 1/1996 Finn
5,547,620 A * 8/1996 Guiotto ..... A43B 13/141 264/273
5,699,627 A * 12/1997 Castro ..... A43B 7/06 36/35 R
5,725,823 A * 3/1998 Finn ..... B29D 35/142 36/31
D394,342 S 5/1998 Schneider
D402,451 S 12/1998 Wunsch
6,209,226 B1 * 4/2001 Squadroni ..... A43B 7/08 36/141
D467,408 S 12/2002 Chen
D487,618 S 3/2004 Amado et al.
D488,916 S 4/2004 McClaskie
D498,351 S 11/2004 Morgan
D501,293 S 2/2005 Bizzo
6,889,452 B2 5/2005 Ailey et al.
7,056,558 B2 6/2006 Daniels et al.
D532,585 S 11/2006 McDonald
D575,039 S 8/2008 Amado et al.
D577,183 S 9/2008 Link
D577,883 S 10/2008 Link
D634,923 S 3/2011 Lacey
D659,969 S 5/2012 Vattes
8,800,170 B1 * 8/2014 Khaitan ..... A43B 17/026 36/28
D772,545 S 11/2016 Jia
9,615,630 B2 4/2017 Jackson
D794,928 S 8/2017 Fu
D796,175 S 9/2017 Mitchell
9,781,973 B2 10/2017 Singh et al.
9,833,040 B2 * 12/2017 Khaitan ..... A43B 7/1425
D828,989 S 9/2018 Buck
D837,499 S 1/2019 Maier
D858,970 S 9/2019 Buck
D859,803 S 9/2019 Buck
D861,311 S 10/2019 Hatfield
D882,924 S 5/2020 Rasmussen
D995,077 S 8/2023 Shepherd et al.
D1,015,709 S 2/2024 Haire
D1,041,843 S 9/2024 Holmes
D1,047,386 S 10/2024 Cruz
D1,047,389 S 10/2024 Klug
D1,047,393 S 10/2024 Ellis
D1,047,395 S 10/2024 Cruz
D1,050,701 S 11/2024 Nethongkome
2005/0132611 A1 * 6/2005 Polcek ..... A43B 21/00 36/35 R
2006/0053660 A1 3/2006 Lewton
2007/0130801 A1 6/2007 Wu
2007/0151124 A1 * 7/2007 Chan ..... A43B 7/1445 36/35 R
2008/0060226 A1 * 3/2008 Rie ..... A43B 21/24 36/99
2008/0127516 A1 * 6/2008 Sessa ..... A43B 13/12 36/12
2009/0126223 A1 5/2009 Metzger
2012/0139156 A1 * 6/2012 Zhang ..... B29D 35/0018 264/254
2012/0324758 A1 * 12/2012 Tang ..... A43B 7/144 36/28
2013/0000157 A1 * 1/2013 Wu ..... A43B 13/12 36/30 A
2015/0052777 A1 * 2/2015 Jennings ..... A43B 13/18 36/28
2015/0113838 A1 4/2015 Harris
2015/0164180 A1 6/2015 Lee
2015/0245685 A1 9/2015 Cross et al.
2016/0135537 A1 5/2016 Wawrousek et al.
2019/0029364 A1 * 1/2019 Lucca ..... A43B 13/188
2020/0037707 A1 * 2/2020 Anderson ..... A43B 21/20
2020/0128906 A1 * 4/2020 Fossum ..... A43B 13/40
2020/0170337 A1 * 6/2020 Lucca ..... A43B 13/122
2020/0383427 A1 * 12/2020 Mason ..... A43B 7/088
2021/0022441 A1 * 1/2021 Shiue ..... A43B 13/37
2021/0235814 A1 * 8/2021 Ye ..... A43B 17/02
2021/0392997 A1 12/2021 Berberian et al.
2022/0183419 A1 * 6/2022 Pham ..... A43B 17/006
2022/0233341 A1 * 7/2022 Werremeyer ..... A43B 7/1425

FOREIGN PATENT DOCUMENTS

CN 205947255 U 2/2017
CN 206620935 U 11/2017
CN 209677501 U 11/2019
CN 209769162 U 12/2019
CN 215075861 U 12/2021
CN 307708962 S 12/2022
DE 356043 C * 5/1920
ES 1073473 U 12/2010
FR 1353960 A * 2/1964 ..... A43B 13/223
FR 2540001 A1 * 8/1984 ..... B65G 15/42
GB 120297 A * 11/1918 ..... A43B 13/223
GB 138229 A * 2/1920 ..... A43B 13/223
GB 357918 A * 10/1931 ..... A43B 13/22
GB 756453 A * 9/1956 ..... A43B 13/223
GB 1511296 A * 5/1978 ..... A43B 13/14
GB 2058545 A 4/1981
GB 6234591 S 9/2022
JP 3135875 U 9/2007
KR 20120008226 U 12/2012
KR 101347216 B1 1/2014
WO 2020031211 A1 2/2020
WO 2020040789 A1 2/2020

OTHER PUBLICATIONS

"7D Soft Memory Foam Insole Pads", undermyfeetshoetique.com, Retrieved from https://www.undermyfeetshoetique.com/products/7d-soft-memory-foam-insole-pad-inserts-heel-post-back-breathable-anti-slip-for-women-high-heel-shoe-shoe-arch-support-insoles, date unknown, 1 page.

Fisher, Betsy, "A Comfortable Pump: Grail Found? w/Sandra Powers Murphy", 1000 Fibers Connect US, Retrieved from https://www.buzzsprout.com/1958214/13673515-a-comfortable-pump-grail-found-w-sandra-powers-murphy, date unknown, See, 2 pages.

"Aerosole Women's Size 7.5" Flat Rust Colored Leather Flats", craigslist.com, Retrieved from https://pittsburgh.craigslist.org/clo/

(56) References Cited

OTHER PUBLICATIONS d/oakdale-aerosole-womens-size-75-flat/7755662195.html, date unknown, 1 page.
"Bellcon Leather Insoles for Women High Heels Thin Leather Insoles for Women Pointed Shoe Inserts for Dress Shoes Leather Shoe Insoles for Sweat Absorption Nonslip Shoe Pads, 3 Pairs/Womens 9-10 M US", amazon.com, Retreived from https://a.co/d/0fExgKaq, date unknown, 2 pages.
"Pointed Toe Insoles-Solid Black", vivaia.com, Retrieved from https://www.vivaia.com/item/pointed-toe-insoles-solid-black-p_4790.html?gid=4792, date unknown, 1 page.
"Diamond Pattern Outsole", Google Image search results, date unknown, 3 pages.
Extended European Search Report received for EP Patent Application No. 23782022.0, mailed on Jul. 9, 2025, 9 pages.
"Geox D Bigliana a womens Shoes", amazon.sa., Retreived from https://www.amazon.sa/-/en/Geox-Woman-Bigliana-Shoes-Mahogany/dp/B09N7NR757?th=1, date unknown, 1 page.
"The Inside Scoop on Heeled Shoe Construction", Instagram post, scarlettchase.co, Retrieved from https://www.instagram.com/p/C5XHjIMsdGI/, date unknown, 1 page.
Jaytheseller, "(Women's 6.5) Vintage 90s Black Loafers", depop.com, Retrieved from https://www.depop.com/products/jaythesellerwomens-65-vintage-black-loafers/, date unknown, 1 page.
"Scarlett Chase Patents & Trademarks", scarlettchase.com, Retrieved from https://scarlettchase.com/pages/scarlett-chase-patents-trademarks, 2024, date unknown, 6 pages.
"Pigskin Leather Cushion Inserts for Women, Self-Adhesive Barefoot Cushioning Shoe Insoles for High Heels, Sandals, Dress Shoes and Flats, Sockless Shoe Liners Anti-Slip and Ultra-Absorbent, 1 Pair", amazon.com, Retrieved from https://a.co/d/076IK6fc, date unknown, 2 pages.
"1 Pair Women Feet Massage Pointed High Heels Breathable Sponge Shoe Insoles Pads Apricot", amazon.com, Retrieved from https://www.amazon.com/wsloftyGYd-Massage-Pointed-Breathable-Insoles/dp/B07J38Z3DM?th=1, date unknown, 1 page.
"2 Pairs High Heel Insoles Breathable Cuttable Foam 10 Inch Shoe Pads Comfort Sponge Replacement Shoe Inserts Cushion Shock Absorbing for Women(Black + Apricot, Tip Designs)", amazon.com, Retrieved from https://www.amazon.com/wsloftyGYd-Massage-Pointed-Breathable-Insoles/dp/B07J38Z3DM?th= 1, date unknown, 2 pages.
"Shyanne Women's Round Toe Xero Gravity Insoles", bootbarn.com, Retrieved from https://www.bootbarn.com/shyanne-womens-square-toe-xero-gravity-insoles/2000223529.html?dwvar_2000223529_color=000#q=XERO%2BGRAVITY%2BINSOLES&start=3, date unknown, 1 page.
Notice of Allowance received for U.S. Appl. No. 29/832,698 mailed on Aug. 23, 2024.
Non-Final Office Action received for U.S. Appl. No. 29/832,692 mailed on Jul. 25, 2024.
Notice of Allowance received for U.S. Appl. No. 29/832,692 mailed on Dec. 5, 2024.

* cited by examiner

HIGH-HEELED SHOES AND OUTSOLE FOR SAME

RELATED APPLICATION

This application is a National Phase filing under 35 U.S.C § 371 of International Application No. PCT/US2023/065066 filed Mar. 28, 2023, which claims the benefit of priority to U.S. Provisional Patent Application No. 63/325,120, filed Mar. 29, 2022, each of which is incorporated by reference herein in their entirety.

FIELD OF THE INVENTION

The invention relates to footwear, and more particularly, high-heeled shoes having a support system, outsole and other features that provide improved comfort and stability for the wearer.

BACKGROUND OF THE INVENTION

High-heeled shoes, while stylish, are known for being unsupportive, uncomfortable, and potentially unstable footwear. In sacrificing comfort and stability for style, high-heeled shoes suffer from the following shortcomings:

a. A back heel portion that cuts into the wearer's heel.
b. A lack of any internal support structure to hold the wearer's foot in the shoe.
c. Little or no arch support.
d. A lack of any support from the toe box.
e. Too much pressure exerted on the ball of the wearer's foot, without toe rise.
f. Thin platform with steep slope.
g. Heels are too high, making a wearer feel like she is on stilts.

There is therefore a need for high-heeled shoes (and components thereof) that provide improved comfort and stability for the wearer, without sacrificing the style and aesthetic qualities of the shoe.

SUMMARY OF THE INVENTION

The following presents a simplified summary of the innovation in order to provide a basic understanding of some aspects of the invention. This summary is not an extensive overview of the invention. It is intended to neither identify key or critical elements of the invention nor delineate the scope of the invention. Its sole purpose is to present some concepts of the invention in a simplified form as a prelude to the more detailed description that is presented later.

In one embodiment, the invention includes a shoe outsole comprising an inside surface and an outside surface opposite the inside surface. The outside surface includes a posterior portion; an anterior portion continuous with the posterior portion and having an integral raised platform.

In another embodiment, the invention includes a shoe comprising a high heel; an upper body; and a shoe outsole engaging the upper body. The shoe outsole incudes an inside surface; and an outside surface opposite the inside surface. The outside surface has a posterior portion, an anterior portion continuous with the posterior portion and an integral raised platform formed on the anterior portion.

BRIEF DESCRIPTION OF THE DRAWINGS

The accompanying figures, which are incorporated in and constitute a part of the specification, illustrate preferred embodiments of the invention and, together with the description, serve to explain the objects, advantages, and principles of the invention. Embodiments of the invention are in no way limited by the following figures.

DETAILED DESCRIPTION OF THE INVENTION

Figure 1:
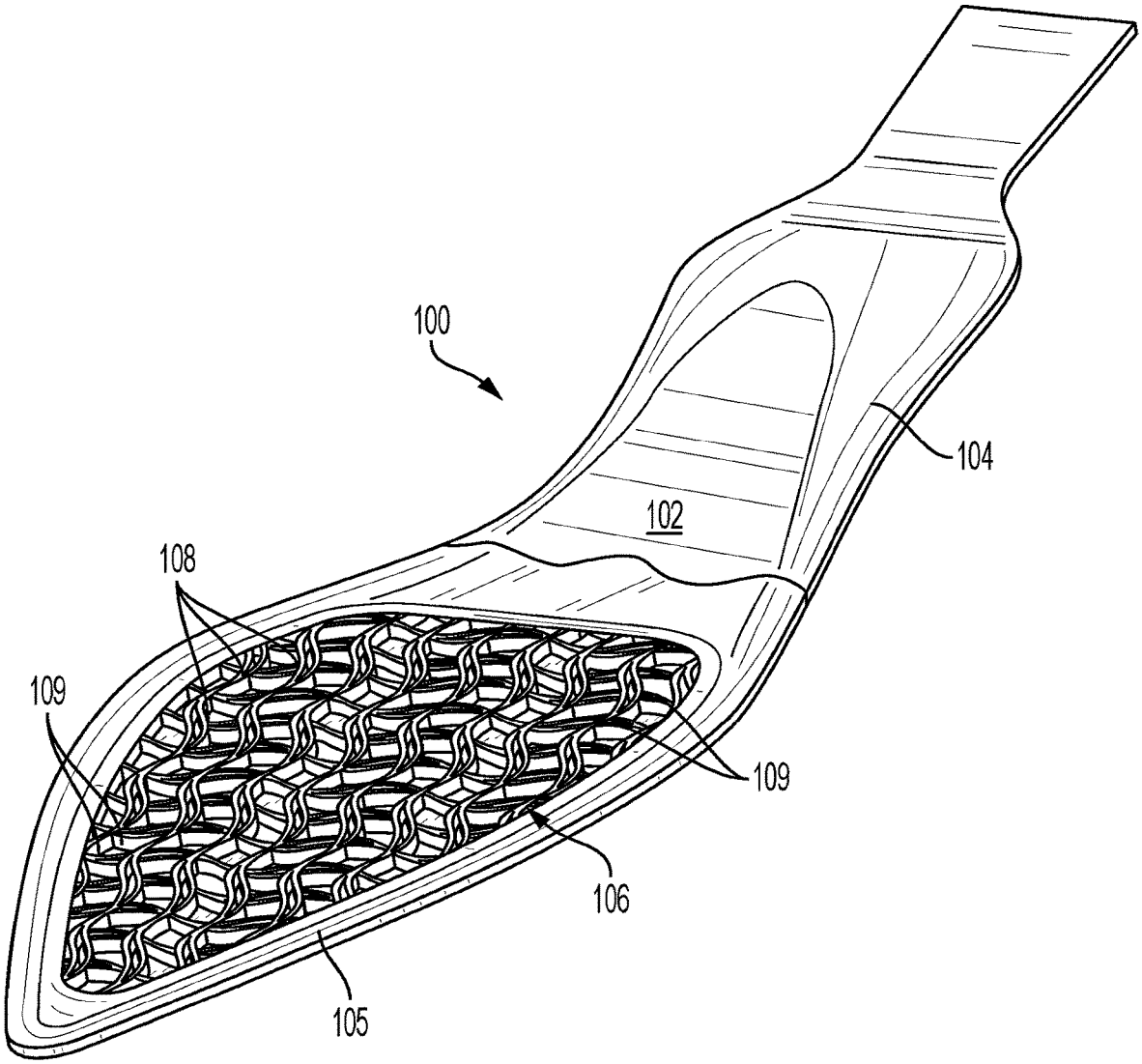
FIG. 1 is a top perspective view of a shoe outsole according to an embodiment of the present invention.
Figure 2:
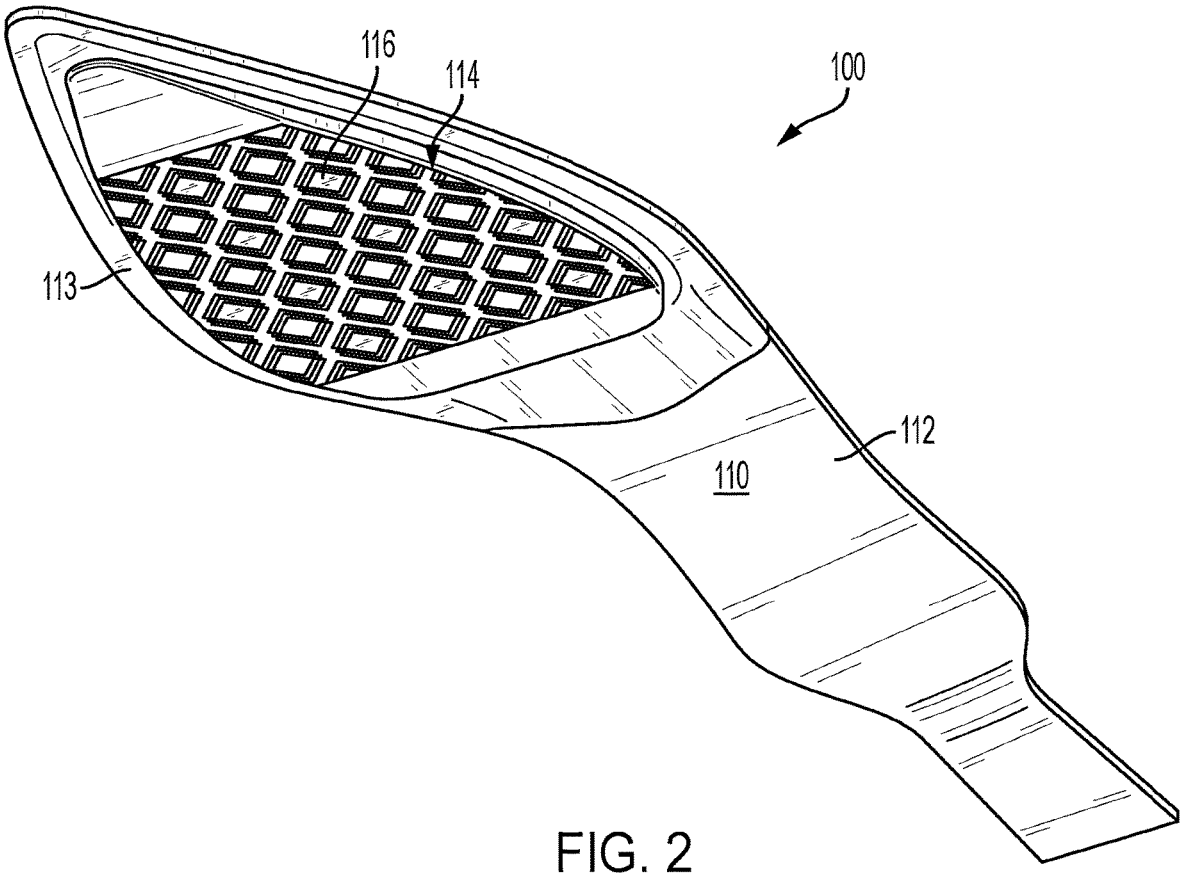
FIG. 2 is a bottom perspective view of the shoe outsole of FIG. 1.
Figure 3:
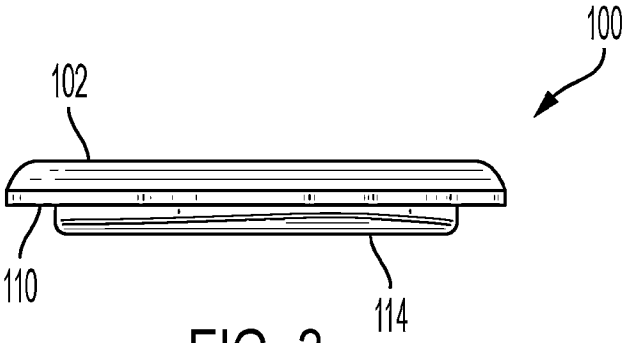
FIG. 3 is a front view of the shoe outsole of FIG. 1.
Figure 4:
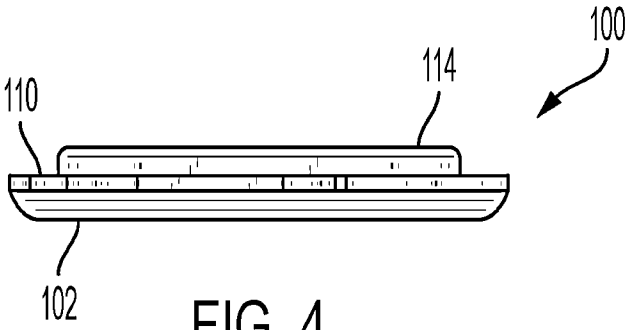
FIG. 4 is a rear view of the shoe outsole of FIG. 1.
Figure 5:
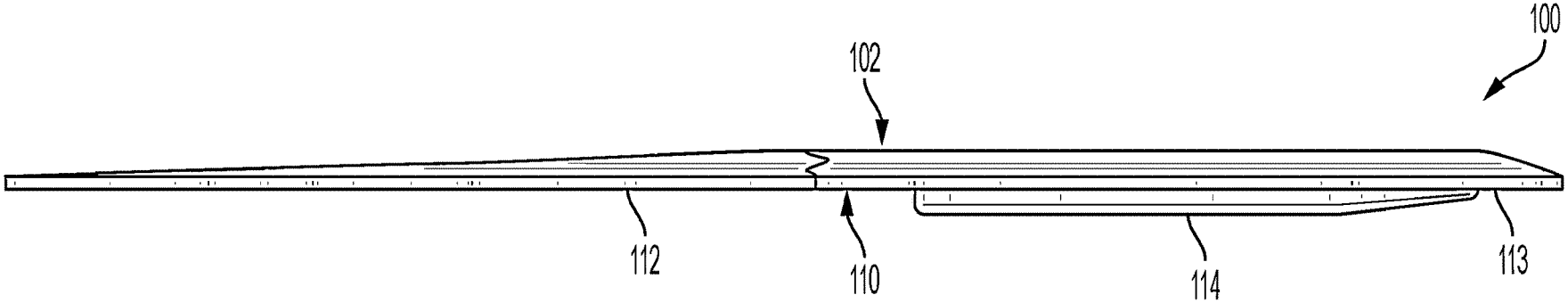
FIG. 5 is a left side view of the shoe outsole of FIG. 1.
Figure 6:
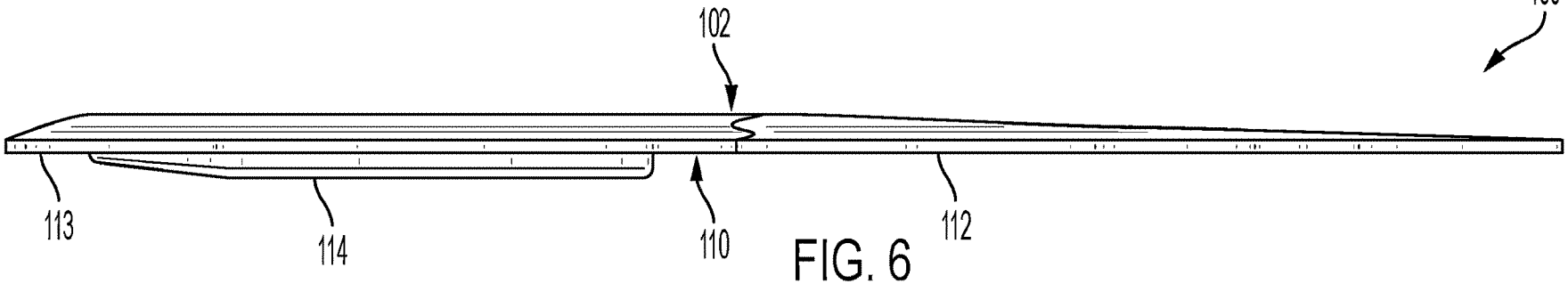
FIG. 6 is a right side view of the shoe outsole of FIG. 1.
Figure 7:
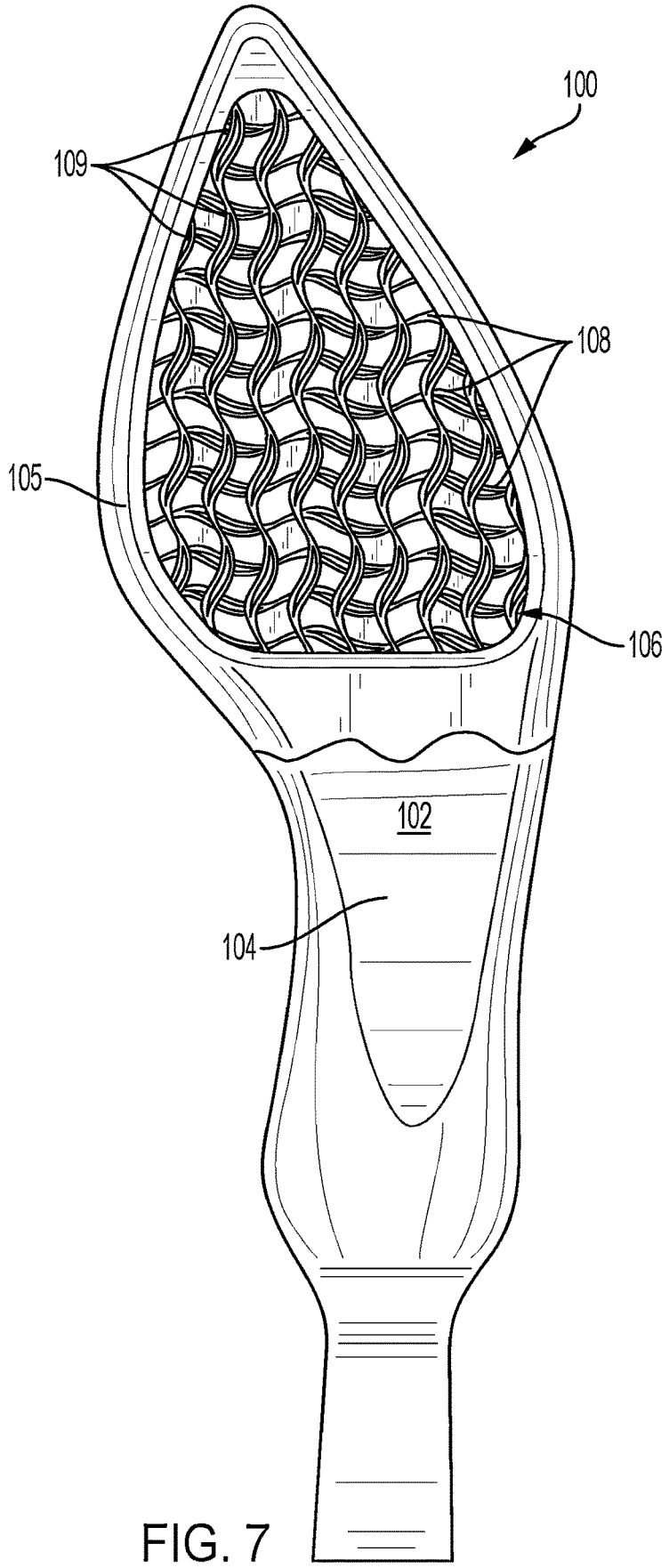
FIG. 7 is a top plan view of the shoe outsole of FIG. 1.
Figure 8:
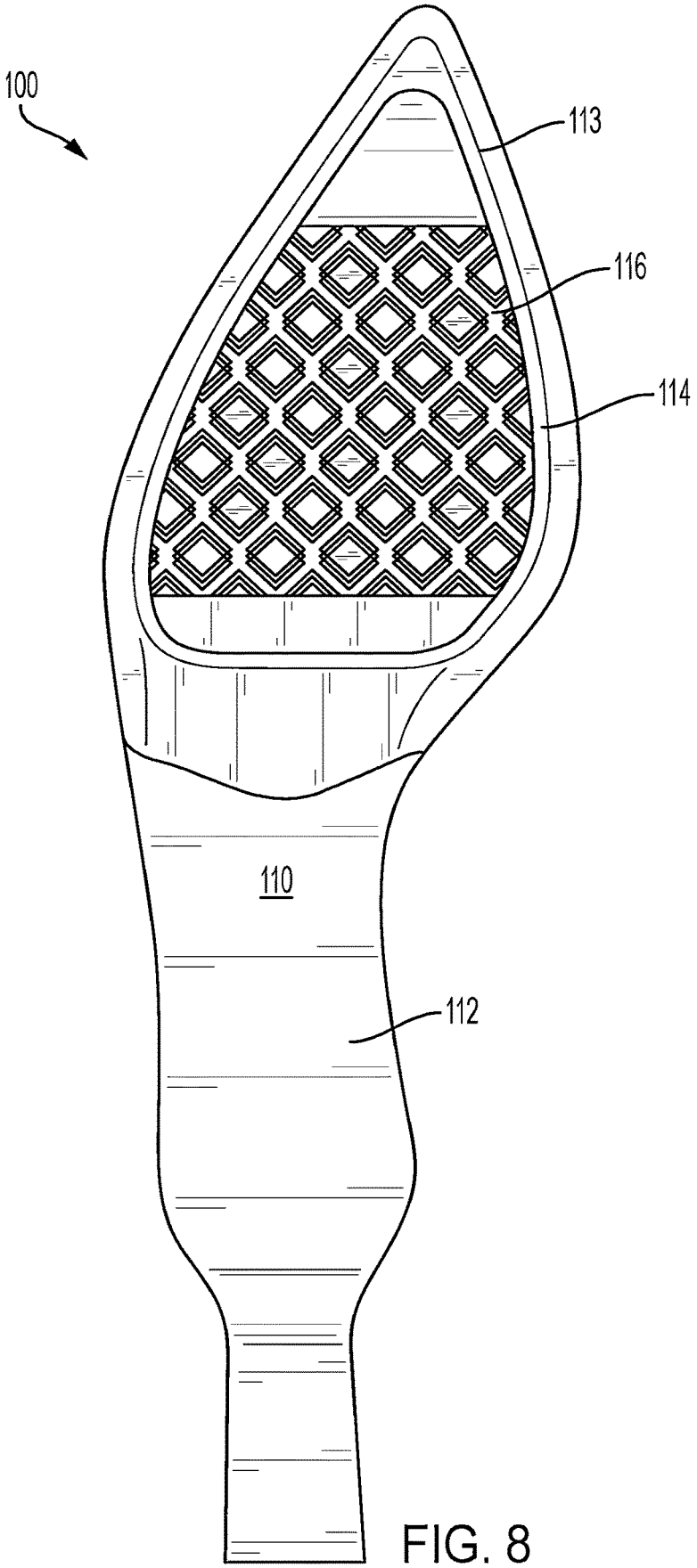
FIG. 8 is a bottom plan view of the shoe outsole of FIG. 1.
Figure 9:
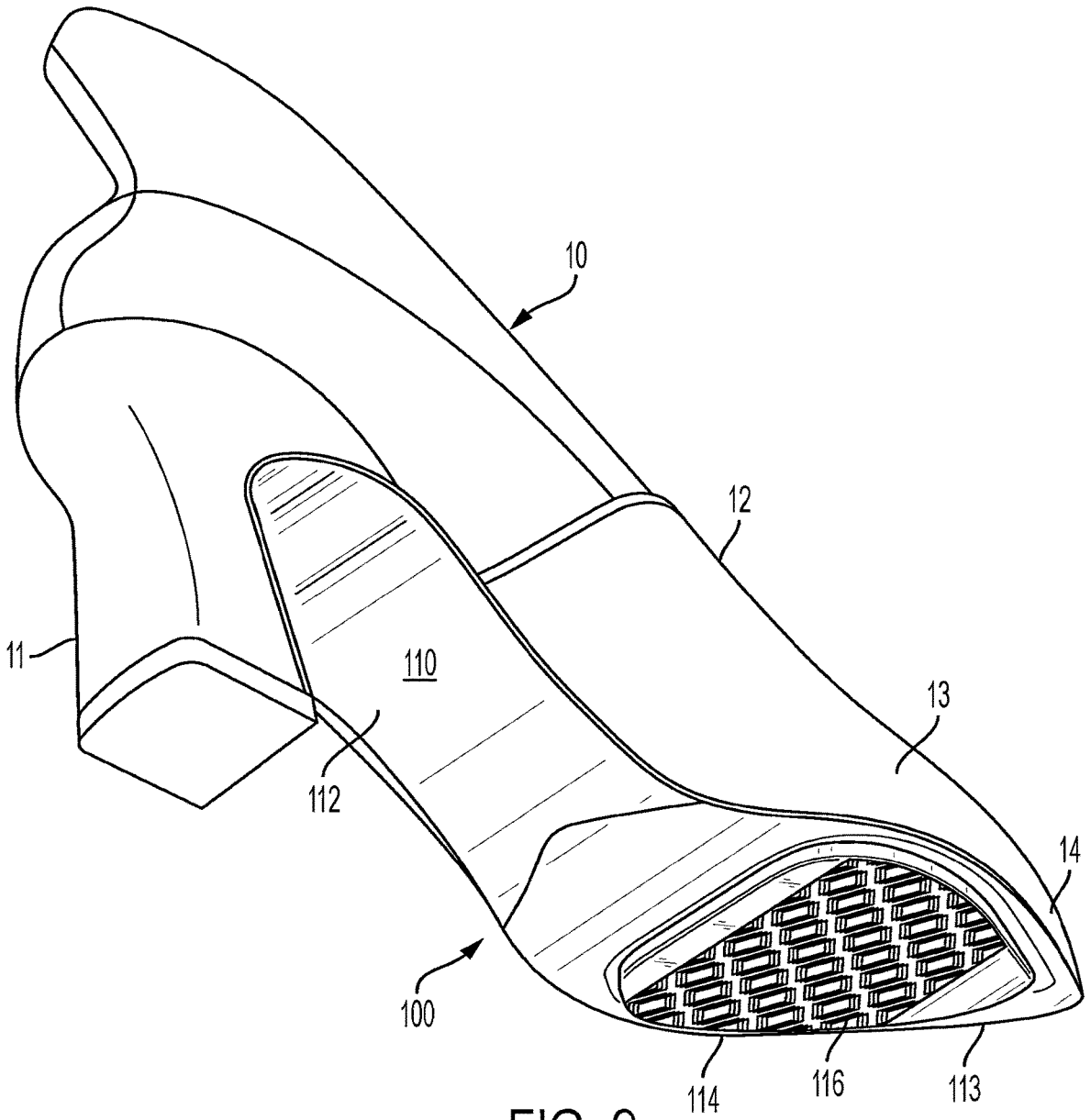
FIG. 9 is a bottom perspective view of a high-heeled shoe incorporating the shoe outsole of FIG. 1.
Figure 10:
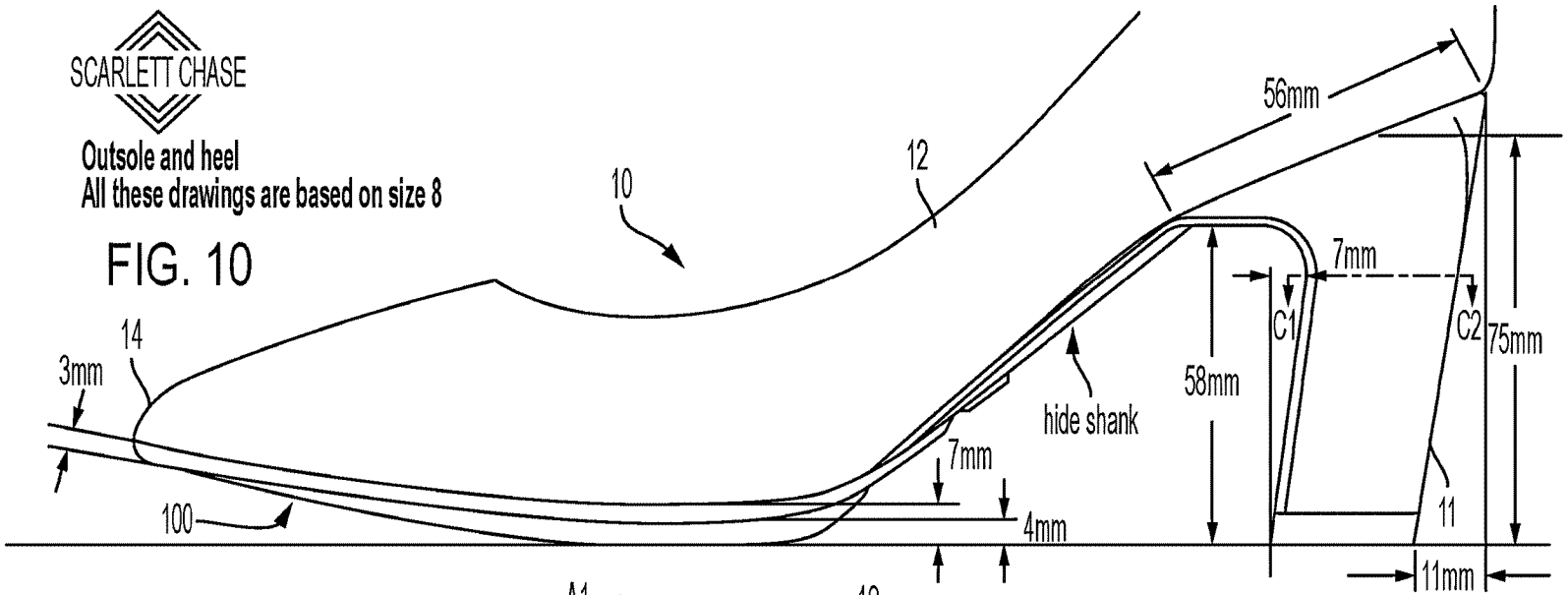
FIG. 10 is a partial left side view of the shoe and outsole of FIG. 9.

For clarity and convenience, the meaning of some terms and phrases used in the specification, examples, and appended claims, are provided below. Unless stated otherwise, or implicit from context, the following terms and phrases include the meanings provided below. The definitions are provided to aid in describing particular embodiments, and are not intended to limit the claimed invention, because the scope of the invention is limited only by the claims. Unless otherwise defined, all technical and scientific terms used herein have the same meaning as commonly understood by one of ordinary skill in the art to which this invention belongs. If there is an apparent discrepancy between the usage of a term in the art and its definition provided herein, the definition provided within the specification shall prevail.

As used in this specification and the appended claims, the singular forms "a," "an" and "the" include plural referents unless the content clearly dictates otherwise.

As used herein, the term "approximately" or "about" in reference to a value or parameter are generally taken to include numbers that fall within a range of 5%, 10%, 15%, or 20% in either direction (greater than or less than) of the number unless otherwise stated or otherwise evident from the context (except where such number would be less than 0% or exceed 100% of a possible value). As used herein, reference to "approximately" or "about" a value or parameter includes (and describes) embodiments that are directed to that value or parameter. For example, description referring to "about X" includes description of "X".

As used herein, the term "or" means "and/or." The term "and/or" as used in a phrase such as "A and/or B" herein is intended to include both A and B; A or B; A (alone); and B (alone). Likewise, the term "and/or" as used in a phrase such as "A, B, and/or C" is intended to encompass each of the following embodiments: A, B, and C; A, B, or C; A or C; A or B; B or C; A and C; A and B; B and C; A (alone); B (alone); and C (alone).

As used herein, the term "comprising" means that other elements can also be present in addition to the defined elements presented. The use of "comprising" indicates inclusion rather than limitation.

The term "consisting of" refers to compositions, methods, and respective components thereof as described herein, which are exclusive of any element not recited in that description of the embodiment.

Reference is made in detail to the presently disclosed embodiments of the invention, examples of which are illustrated in accompanying drawings, where in like reference numerals refer to like elements throughout.

Disclosed herein are high-heeled shoes having at least the features enumerated below (with their respective metric descriptions and exemplary measurements):

1. Upper Cradle Construction

Metric Description: Measurement of the avoidance of the first metatarsal head based on the upper dimensions and shoe girth with the objective of avoiding bunion exacerbation. The upper construction is designed to maximize foot space in and around the toe box, and to avoid the top edge of the upper landing on the first metatarsal head, instead wrapping up and around this common pressure point. Materials used for upper construction are also designed to further extend the cushioning and wearability of the shoe, by providing malleable, soft, hammered edges to avoid rubbing, digging and pressure on the first metatarsal head bone structure.

Exemplary Measurements: The upper construction of the shoe includes a toe tip to throat measurement of 76 mm. The upper width is 62 mm at the widest part of the opening, providing sufficient space for the wearer's foot without landing on the first metatarsal head, often considered the bunion area. The widest part of the opening, at 62 mm, to the toe tip, runs an additional 105 mm, also providing the wearer with more vertical space from ball of foot to toe point. The combination of measurements results in a longer forefoot and wider upper with more accommodation for foot girth to assist the wearer in avoiding aggravating the first and fifth metatarsal phalangeal joints. The bite line is engineered to avoid the metatarsal phalangeal joints, in particular the first and fifth, creating a cradle for the foot to avoid abrasion on traditional bunion area. The edging is skived and pounded to be butter soft/non-abrasive resulting in 0 redness/discoloration and discomfort.

2. Foot Delta Construction

Metric Description: Measurement of the delta/variance in positioning from the wearer's heel to the wearer's ball of foot given ball of foot lift from outsole and insole combined.

Exemplary Measurements: Forefoot lift from the combination of the outsole and insole is approximately 15 mm, vs. a traditional 5-6 mm, creating a reduced delta between ball of foot and heel equivalent by adjusting foot positioning and thus heel height feeling by 10 mm.

3. Heel to Toe Enablement

Metric Description: Stability of a walker on the heel and ability to walk heel to toe based on design, across sidewalk grates and grass without risk of heel implantation, ensuring walker stability to walk heel to toe. Lack of wabble as heel provides sufficient circumference to support body weight.

Exemplary Measurements: Heel length of 24 mm, heel width of 24 mm; Measurement of pressure on the stiletto heel. Lower pressures and/or higher heel area may be correlated with increased comfort levels, based on calculation of pressure:

Pressure=force/area, where force=mass times gravity.

Mass is the shoe wearer's weight (in kg), and gravity is 9.8 meters/(seconds)$^2$.

4. Invisible Lift Anti-Grip Stability Outsole (Also Discussed Further Below)

Metric Description: The molded outsole at its thickest part is exactly 4.0 mm, and it sits 8.0 mm from a side edge of the shoe to create invisible lift. The 4.0 mm thickest point then begins a taper 20 mm from the toe edge, tapering gradually from 4.0 mm to 1.0 mm. This taper provides for continued stability while ensuring shock attenuation. The impact of the anti-slip grip outsole material with etched logo diamonds under the forefoot platform creates greater contact of outsole to smooth ground surface resulting in a higher friction coefficient than a traditional leather outsole.

Exemplary Measurements: 4 mm thickness, 8 mm from shoe side edge, taper to 1 mm & etched thermoplastic polyurethane (or thermoplastic rubber) with a repeat pattern creating interlocking slip resistance.

5. Orthotic Arch Cloud Molded Insole

Metric Description: The molded insole creates an orthotic level arch support of 11.5 mm, from its 5 mm base, as well as an offsetting heel cup and pronounced ball of foot support up to 6 mm prior to tapering towards the toe. This molded insole provides a cradle that supports the support construction from heel to toe.

Exemplary Measurements: 11.5 mm arch height, 6 mm metatarsal pad raise for shock attenuation and lift built with Ortholite® open cell, rebounding foam for continued bounce back support and consistent fit.

Exemplary embodiments of the molded insole are shown in FIGS. 17-27.

6. Heel Pillow

Metric Description: Counter pocket cushioning implanted behind the wearer's heel built into the shoe lining to provide enhanced cradling and fit, avoiding heel slip and blisters on the back of heel.

Exemplary Measurements: Foam between upper lining and back of heel creating a built-in collar for back of heel comfort and fit flexibility.

Shoe Elements and Support System

As shown in the figures (see FIGS. 9-16 specifically), the high-heeled shoe of the present invention includes a support system that is designed to cradle a wearer's foot in fully integrated, seamless cushioning and support to maximize agility, stability in motion, and to extend wear. Benefits include reduction of bunion exacerbation, definitive orthotic arch support, and cradling heel cup & back of heel integrated padding.

In addition to specific elements designed to maximize cushioning and support in the shoe's upper construction, insole construction, outsole construction and heel construction, the overall shoe design is intended to minimize the delta between the ball of a wearer's foot and heel, while minimizing the bulk, weight and thickness of shoes designed for support alone. The shoe support system is designed to create an unprecedented reduction of 10 mm in the delta between the heel and ball of foot as a direct result of the shoe's heel construction (i.e., providing a 15 mm total depth) vs. a traditional heel (i.e., providing only 5 mm total depth).

The shoe support system's padded insole and outsole elements, combined with arch support, heel cup and stable heel platform, combined with an upper designed to avoid bunion damage, all support the natural alignment of the foot and provide sufficient room for ball of foot, toes and heels, thereby creating a supportive host environment for maximizing a wearer's stability, agility and enjoyment while avoiding the creation or exacerbation of common women's foot problems (i.e., from wearing poorly-designed/constructed high-heeled shoes and other footwear) including metatarsal bone spurs, falling arches and plantar fasciitis.

Stability Outsole

An embodiment of the shoe outsole of the present invention is illustrated in FIGS. 1-11B, 13 and 16.

A shoe 10 includes a high heel 11, an upper body 12 and outsole 100. The outsole 100 of the shoe 10 includes an inside surface 102 (see FIGS. 1 and 7) and an opposed outer surface 110 (discussed below). The inside surface 102 includes a posterior leather portion 104 and an anterior portion 105 at least part of which is textured 106 and thereby configured as an air-circulating, wide base that contacts the ball of the wearer's foot (i.e., metatarsal pad), supports shock attenuation and provides stability without excessive weight or bulk. The textured portion 106 includes a plurality of overlapping elements 108 and openings 109 therebetween, both of which provide the texture and promote air circulation.

The outside surface 110 of the shoe outsole 100 is best shown in FIGS. 2, 8, 9, 11-11B and 13. The outside surface 110 includes a posterior leather portion 112 (i.e., the opposite surface/side of the posterior leather portion 104) and an anterior metatarsal portion 113 which includes a raised, shock-attenuating, wide base platform/pad 114. The platform 114 is configured to provide stability and dispersed contact with the ground/floor surface (i.e., distributing the wearer's weight over a larger area), full metatarsal pad support, and forefoot lift without excessive weight or bulk.

The outsole 100 is formed (e.g., molded) as a fully integrated, single-component, two-tiered outsole with the anterior metatarsal portion 113 and built-in forefoot raised platform 114 that is invisible from side and vertical angles. The anterior metatarsal portion 113 and raised platform 114 are formed from a resilient material, preferably thermoplastic polyurethane (TPU), or thermoplastic rubber (TPR), which provides an anti-slip grip with the ground/floor surface. In alternate embodiments, the anterior metatarsal portion 113 and platform 114 may be formed from other materials.

The outsole 100 is further graded to provide toe spring and to maximize the stability and mass dispersion of the shoe through dynamic outsole dimensions and platform integration placement. While previous manufacturers have attempted to address grip, and others to create a platform, no other outsole has integrated the specific elements of the outsole 100 of the present invention, combining the optimum incorporation of forefoot lift, ball of foot dispersed support, anti-slip grip and a molded platform 114 with specific dimensions that render the platform 114 invisible (i.e., from the side and vertical angles), yet fully stabilizing across the ball of the wearer's foot.

Figure 11:
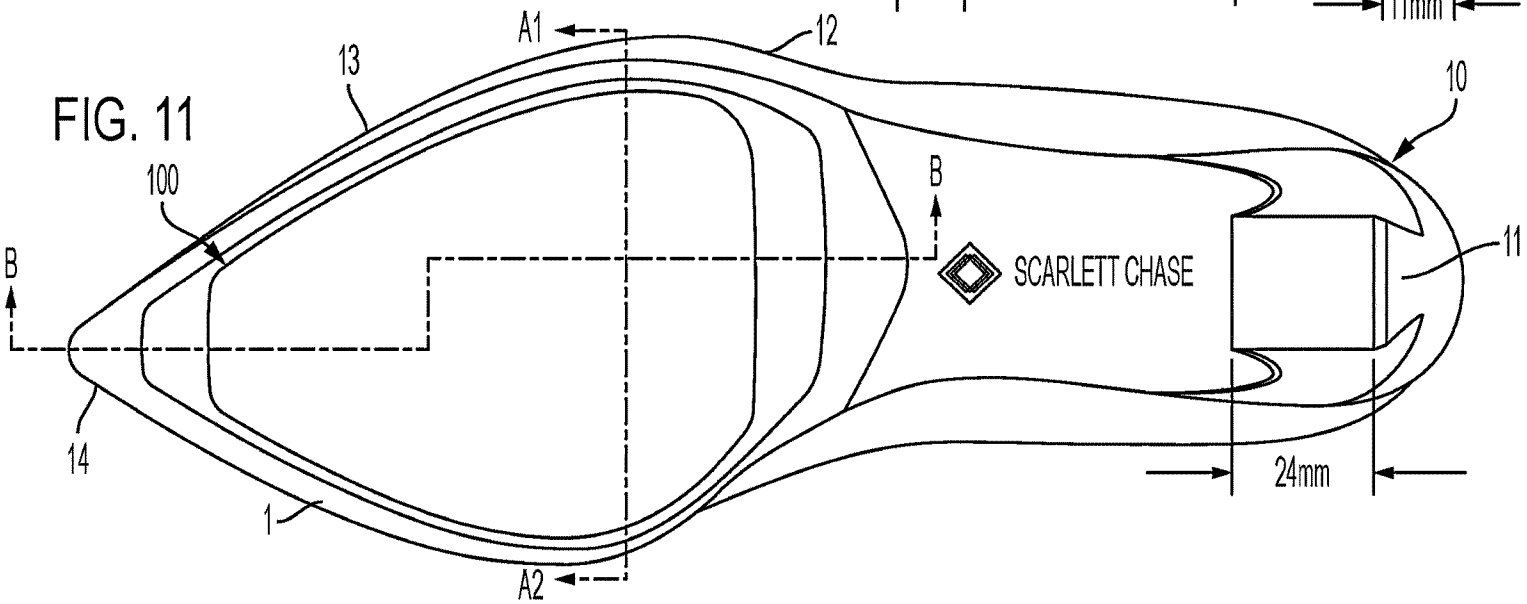
FIG. 11 is a bottom plan view of the shoe and outsole of FIG. 9.
Figure 11B:
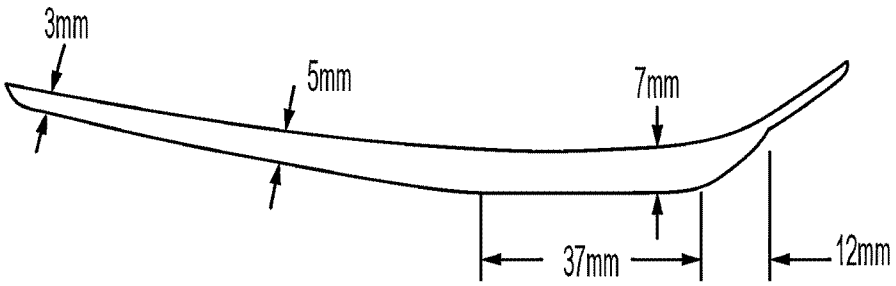
FIG. 11B is a cross-sectional view of the outsole of FIGS. 1 and 11, taken along line B-B.
Figure 11A:
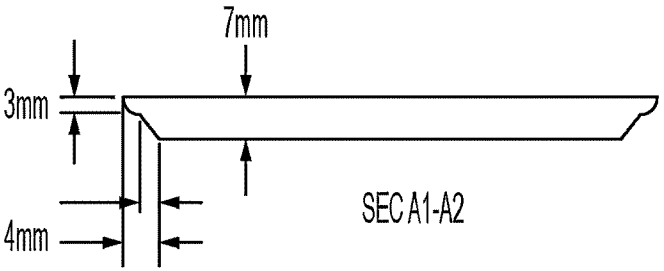
FIG. 11A is a cross-sectional view of the outsole of FIGS. 1 and 11, taken along line A1-A2.
Figure 13:
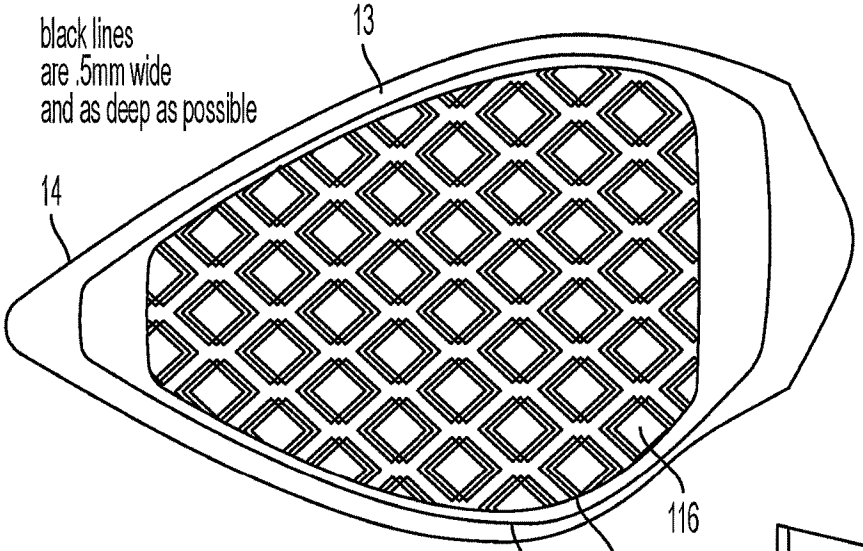
FIG. 13 is a partial bottom plan view of the shoe and outsole of FIG. 9.
Figure 14:
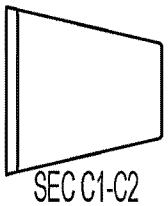
FIG. 14 is a cross-sectional view of the heel of the shoe of FIG. 10, taken along line C1-C2.
Figure 12:
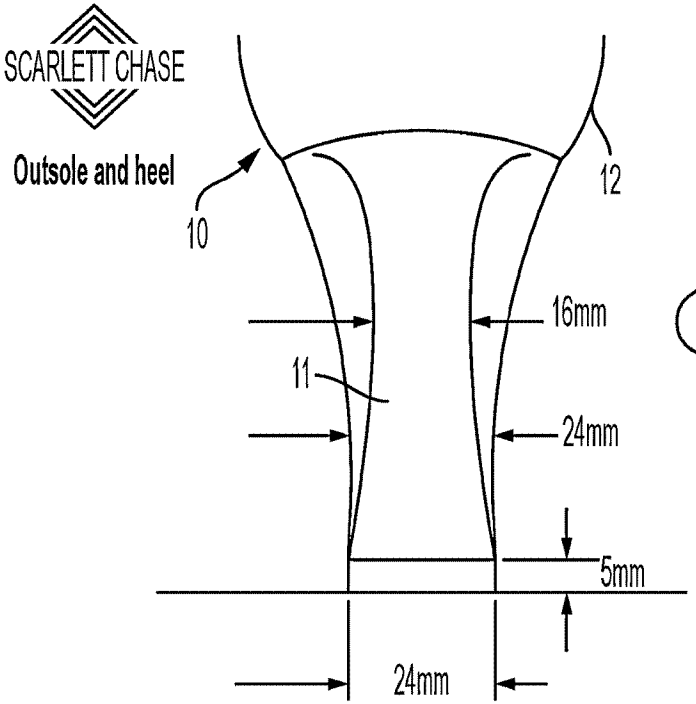
FIG. 12 is a partial rear view of the shoe of FIG. 9.
Figures 15, 16:
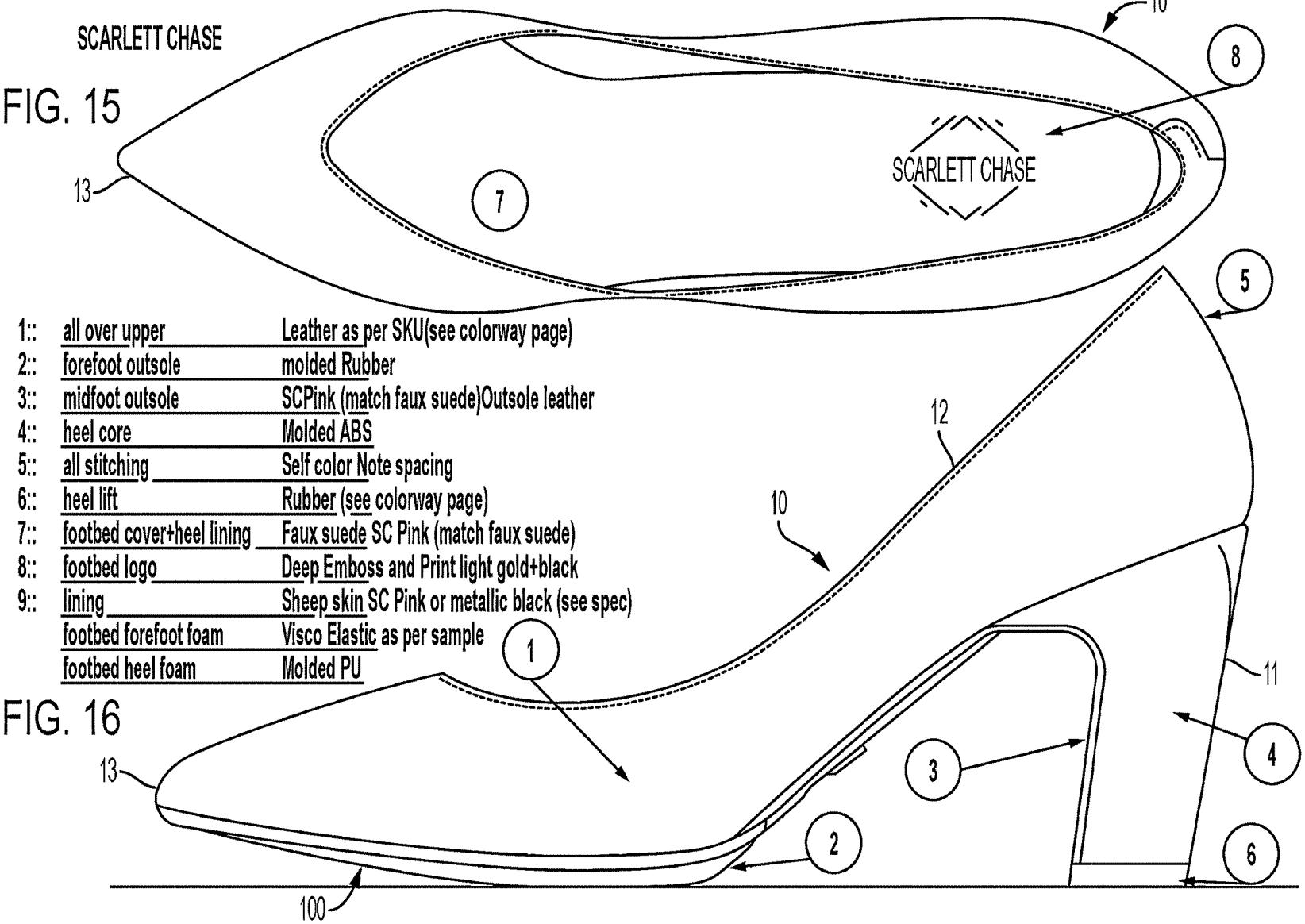
FIG. 15 is a top plan view of the shoe of FIG. 9.
FIG. 16 is a left side view of the shoe and outsole of FIG. 9.
Figure 17:
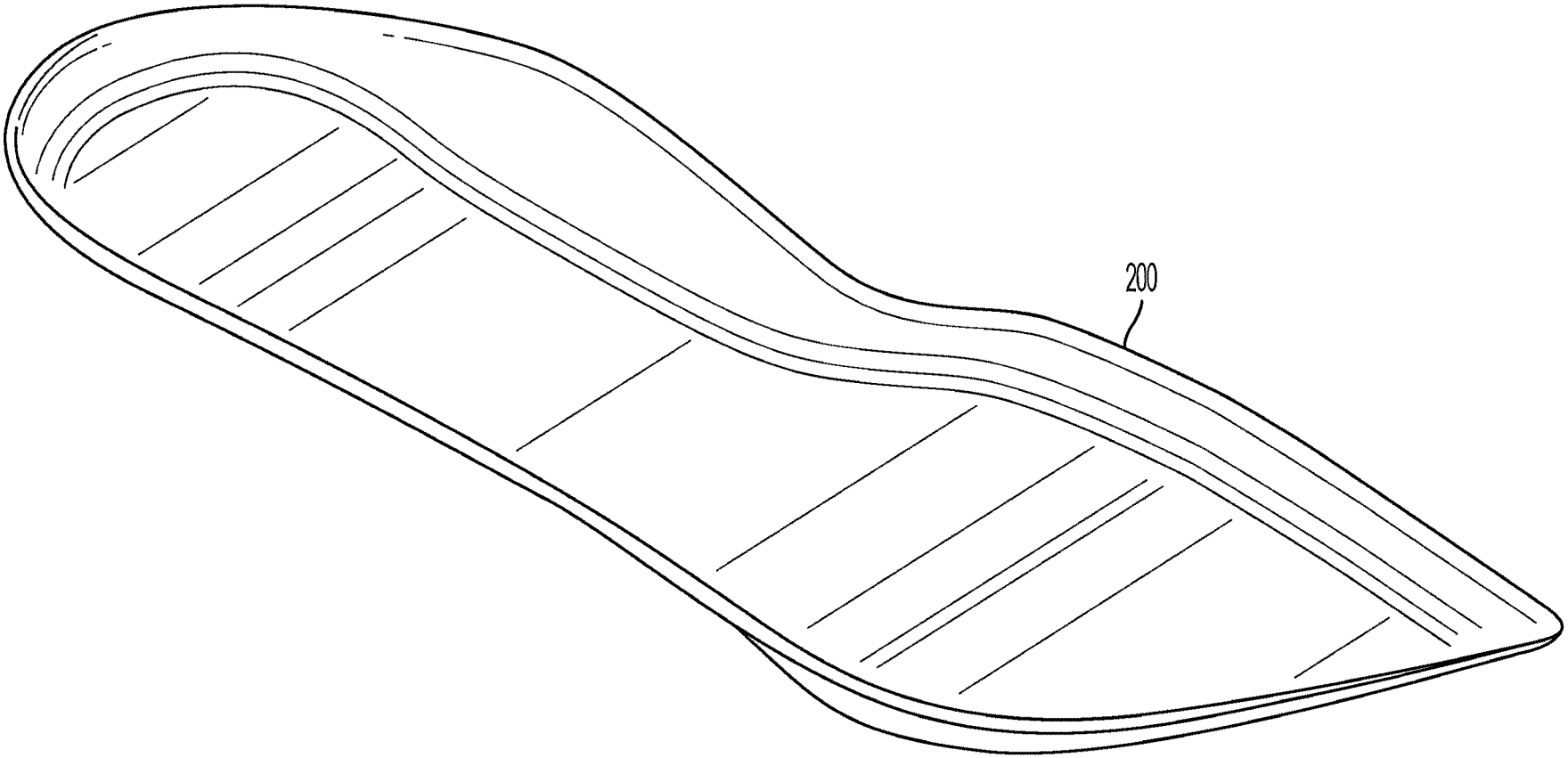
FIG. 17 is a top perspective view of a shoe insole for a right foot according to an embodiment of the present invention.
Figure 18:
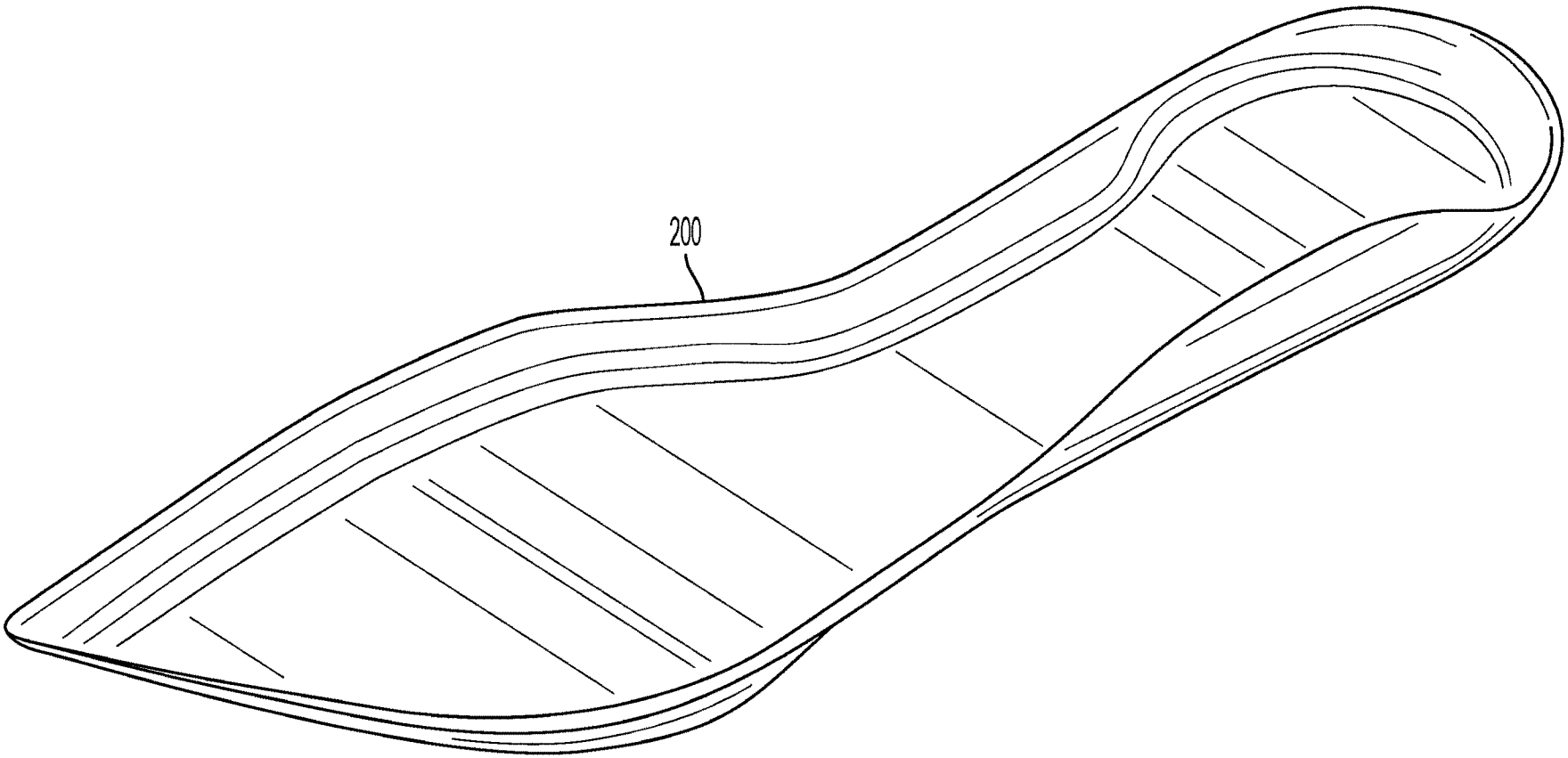
FIG. 18 is a top perspective view of a shoe insole for a left foot according to an embodiment of the present invention.
Figure 19:
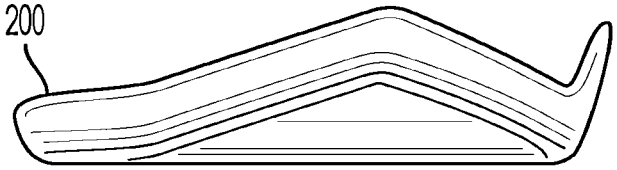
FIG. 19 is a front view of the shoe insole of FIG. 17.
Figure 20:
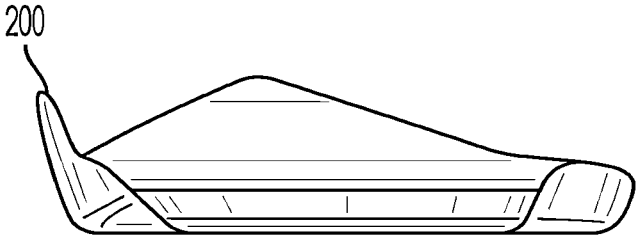
FIG. 20 is a rear view of the shoe insole of FIG. 17.
Figure 21:
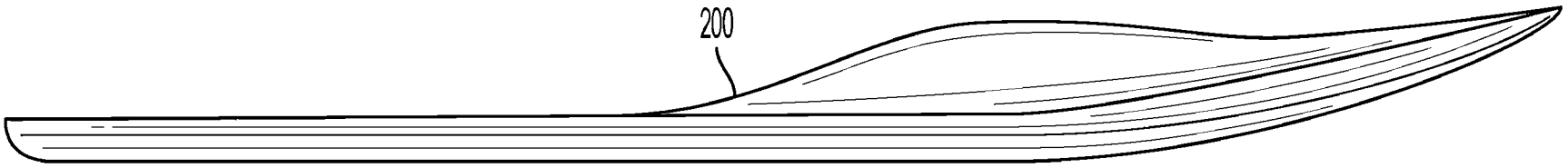
FIG. 21 is a right side view of the shoe insole of FIG. 17.
Figure 22:
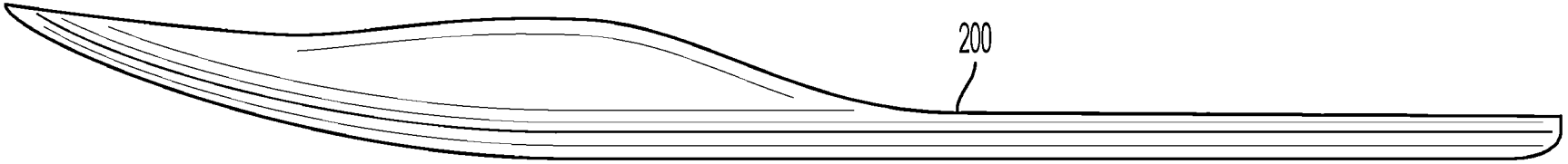
FIG. 22 is a left side view of the shoe insole of FIG. 17.
Figure 23:
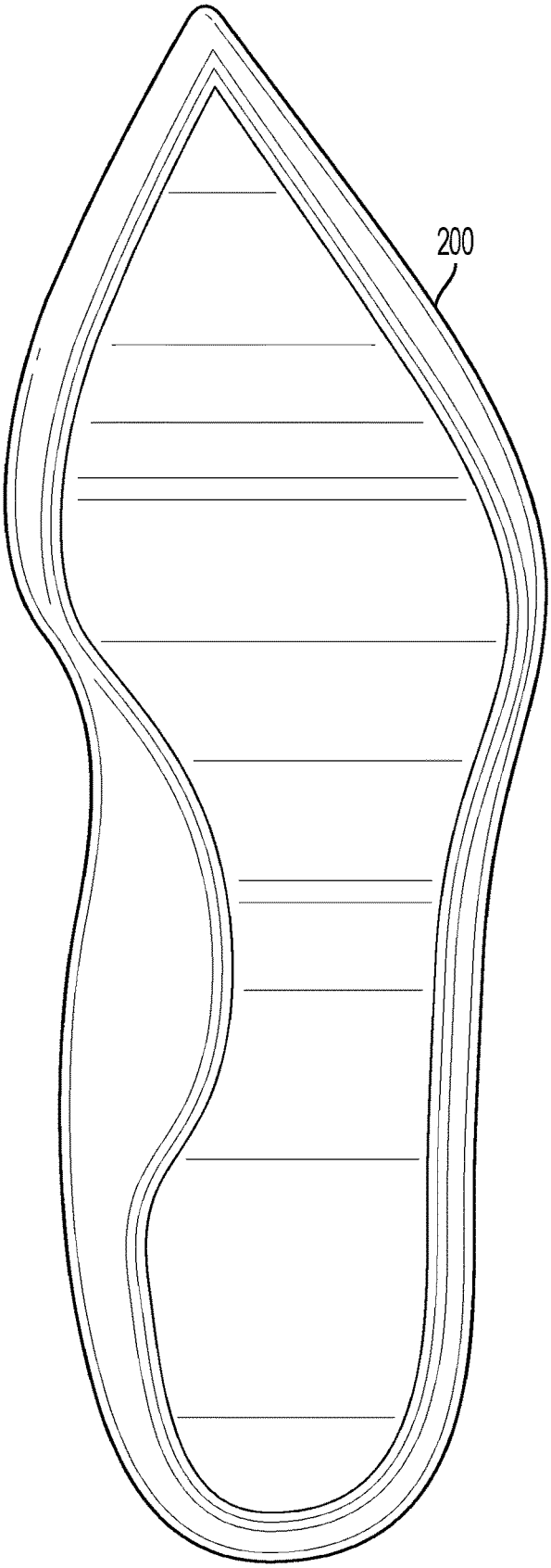
FIG. 23 is a top plan view of the shoe insole of FIG. 17.
Figure 24:
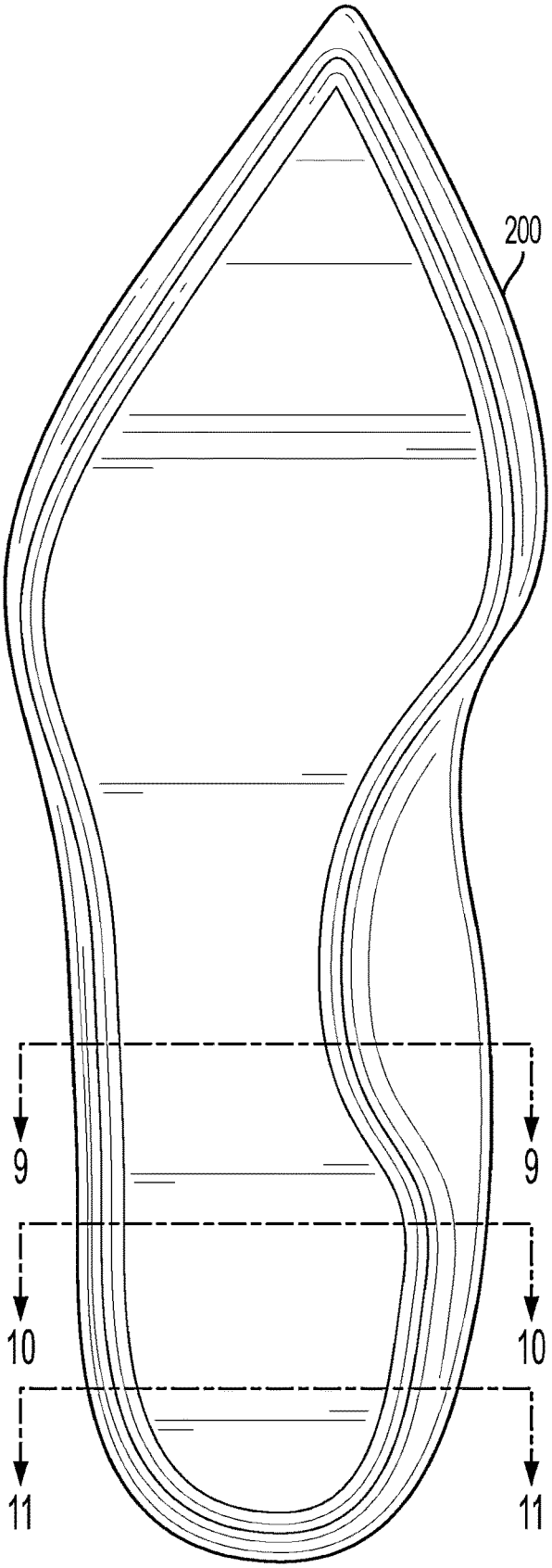
FIG. 24 is a bottom plan view of the shoe insole of FIG. 17, with section lines.
Figure 25:
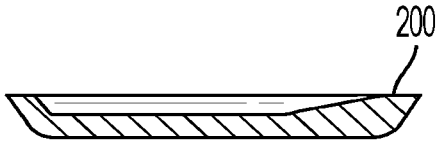
FIG. 25 is a sectional view of the shoe insole of FIG. 17, taken along Line 9-9 of FIG. 24.
Figure 26:
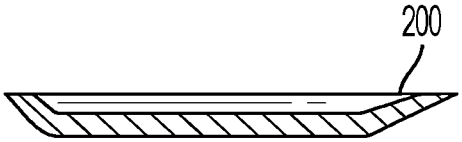
FIG. 26 is a sectional view of the shoe insole of FIG. 17, taken along Line 10-10 of FIG. 24.
Figure 27:
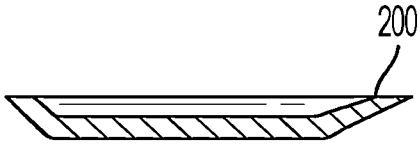
FIG. 27 is a sectional view of the shoe insole of FIG. 17, taken along Line 11-11 of FIG. 24.

In an embodiment, the platform 114 of the outsole 100 has a maximum thickness of 4.0 mm and is positioned 8.0 mm from an outer/side edge 13 of the shoe 10 (see FIG. 11). The 4.0 mm thickest point then begins a taper 20 mm from the toe edge 14, tapering gradually from 4.0 mm to 1.0 mm. This taper provides for continued stability while ensuring shock attenuation.

As shown in FIGS. 2, 8, 9 and 13, the forefoot platform 114 of the anterior metatarsal portion 113 includes an etched pattern 116 (e.g., etched logo diamonds according to various embodiments) on its surface. The pattern 116 creates greater contact/traction between the platform 114 and a smooth ground/floor surface, thereby providing a higher friction coefficient of friction than a traditional leather outsole and facilitating an anti-slip grip. In an embodiment, the etched pattern 116 includes diamonds having a 0.5 mm depth and 0.5 mm width. The coefficient of friction is higher when the surface is smoother (such as when walking on wet cobblestones) with a flat outsole bottom surface that is sufficiently sticky due to the rubber material and pattern 116, which yields more traction for the wearer and reduces the risk of slip.

The molded outsole 100 constitutes a single unit integrating the molded forefoot platform 114 with expanded dimensional depth under the ball of the foot/metatarsal pad and graduating (i.e., tapering) towards the toe edge 14 of the shoe 10 while maintaining an 8 mm distance from the side edge 13 of the shoe 10 to ensure maximum stability and minimum visibility.

As shown in the attached figures, the posterior leather portion 110 of the outsole's outer surface 110 transitions from the support structure of the forefoot platform 114 under the arch and heel tongue for a fully integrated, single unit construction. Such a one-piece construction eliminates the risk of dislodgement or separation of the forefoot platform 114 from the posterior leather portion 112 of the outsole 100.

At its highest point, the forefoot platform 114 has a 4 mm height (for a total of 5 mm in the thickest section of the outsole 100), and tapers to a 1 mm height proximate the toe edge 14 of the shoe 10. The maximum (4 mm) height of the forefoot platform 114 provides the added lift necessary to reduce the delta between the ball of foot and heel positioning within the shoe 10 (in conjunction with other factors including the dimensions of the footpad, the heel cup placement, etc.)

An outsole height of 5 mm total, including 4 mm from the highest point of the molded forefoot platform 114, provides the shock attenuation—its exact distance from the side edge 13 of the shoe 10 (i.e., 8 mm) creating stability and full contact with the ground while lifting the overall forefoot to reduce the delta between the ball of the wearer' foot and heel.

The construction of the outsole 100 is an improvement over/superior to others on the market, at least for the following reasons:

a) Soles that offer a 'platform' typically are significantly higher and fully visible from the side. Any platform that raises the forefoot above 5 mm would be visible from the side and may increase the risk of instability for the wearer.

b) Soles that do not offer the thicker thermoplastic rubber, simply offering a black anti-skid layer on a thin sole, provide nothing in the form of forefoot lift nor shock attenuation.

c) Shoes that include a platform that is not made with thermoplastic polyurethane/rubber and without grid lines (i.e., indentations from the logo icon pattern cut into the platform) will not provide the anti-slip properties/the traction control combination that the outsole of the present invention will.

d) Other outsoles (as noted in a) above), maintain a consistent platform height; therefore, the raised forefoot is not designed with a change in the delta between heel and ball of foot in mind and the construction does not support the wearer in reducing the overall pressure on the ball of the foot to the same degree.

The shoe 10 also includes a molded insole 200 positioned therein. Exemplary embodiments of the insole are shown in FIGS. 17-27. As discussed above, the insole 200 creates an orthotic level arch support of 11.5 mm, from its 5 mm base, as well as an offsetting heel cup and pronounced ball of foot support up to 6 mm prior to tapering towards the toe. This insole provides a cradle that supports the support construction from heel to toe.

Modifications, additions, or omissions may be made to the systems, apparatuses, and methods described herein without departing from the scope of the disclosure. For example, the components of the systems and apparatuses may be integrated or separated. Moreover, the operations of the systems and apparatuses disclosed herein may be performed by more, fewer, or other components and the methods described may include more, fewer, or other steps. Additionally, steps may be performed in any suitable order. As used in this document, "each" refers to each member of a set or each member of a subset of a set.

Other embodiments of the invention will be apparent to those skilled in the art from consideration of the specification and practice of the invention disclosed herein. Although specific advantages have been enumerated above, various embodiments may include some, none, or all of the enumerated advantages. It is intended that the embodiments described above be considered as exemplary only, with a true scope and spirit of the invention being indicated by the appended claims. Moreover, none of the features disclosed in this specification should be construed as essential elements, and therefore, no disclosed features should be construed as being part of the claimed invention unless the features are specifically recited in the claims. In addition, it should be understood that any of the features disclosed on any particular embodiment may be incorporated in whole or in part on any of the other disclosed embodiments.

In any interpretation of the claims appended hereto, it is noted that no claims or claim elements are intended to invoke or be interpreted under 35 U.S.C. 112(f) unless the words "means for" or "step for" are explicitly used in the particular claim.

In general, any combination of disclosed features, components and methods described herein is possible. Steps of a method can be performed in any order that is physically possible.

All cited references are incorporated by reference herein.

Although embodiments have been disclosed, it is not desired to be limited thereby. Rather, the scope should be determined only by the appended claims.

While various embodiment of the present disclosure have been described in detail, it is apparent that modifications and alterations of those embodiments will occur to those skilled in the art. However, it is to be expressly understood that such modifications and alterations are within the scope and spirit of the present disclosure, as set forth in the following claims.

The foregoing discussion of the disclosure has been presented for purposes of illustration and description. The foregoing is not intended to limit the disclosure to the form or forms disclosed herein. In the foregoing Detailed Description for example, various features of the disclosure are grouped together in one or more embodiments for the purpose of streamlining the disclosure. This method of disclosure is not to be interpreted as reflecting an intention that the claimed disclosure requires more features than are expressly recited in each claim. Rather, as the following claims reflect, inventive aspects lie in less than all features of a single foregoing disclosed embodiment. Thus, the following claims are hereby incorporated into this Detailed Description, with each claim standing on its own as a separate preferred embodiment of the disclosure.

Moreover, though the present disclosure has included description of one or more embodiments and certain variations and modifications, other variations and modifications are within the scope of the disclosure, e.g., as may be within the skill and knowledge of those in the art, after understanding the present disclosure. It is intended to obtain rights which include alternative embodiments to the extent permitted, including alternate, interchangeable and/or equivalent structures, functions, ranges or steps to those claimed, whether or not such alternate, interchangeable and/or equivalent structures, functions, ranges or steps are disclosed herein, and without intending to publicly dedicate any patentable subject matter.

In general, any combination of disclosed features, components and methods described herein is possible. Steps of a method can be performed in any order that is physically possible.

I claim:

1. A shoe outsole for a high-heeled shoe, comprising:

(a) a unitary outsole body having an inside surface and an outside surface opposite the inside surface;

(b) wherein the inside surface includes (i) a posterior leather portion, and (ii) an anterior portion including a textured portion configured as an air-circulating wide base that contacts a wearer's metatarsal pad, the textured portion comprising a plurality of overlapping elements and openings therebetween;

(c) wherein the outside surface includes (i) a posterior leather portion, and (ii) an anterior metatarsal portion continuous with the posterior leather portion, the anterior metatarsal portion including a built-in forefoot raised platform;

(d) wherein the outsole body is molded as a fully integrated, single-component, two-tiered outsole, the anterior metatarsal portion and the built-in forefoot raised platform being formed from a resilient material comprising thermoplastic polyurethane (TPU) or thermoplastic rubber (TPR);

(e) wherein the posterior leather portion of the outside surface transitions from a support structure of the forefoot raised platform under an arch and heel tongue to provide a fully integrated, single-unit construction that eliminates risk of dislodgement or separation of the forefoot raised platform from the posterior leather portion;

(f) wherein the built-in forefoot raised platform is positioned 8.0 mm from an outer/side edge of the shoe outsole and has a maximum thickness of 4.0 mm, and wherein a 4.0 mm thickest point begins a taper 20 mm from a toe edge, tapering gradually from 4.0 mm to 1.0 mm;

(g) wherein the forefoot raised platform includes an etched pattern on a surface thereof, the etched pattern including diamonds each having a 0.5 mm depth and a 0.5 mm width; and (h) wherein the textured portion on the inside surface overlies and is aligned with the forefoot raised platform in a forefoot region.

2. The shoe outsole of claim 1, wherein the shoe outsole is formed as a single piece; and wherein the textured portion on the inside surface overlies and is aligned with the forefoot raised platform in the forefoot region of the outsole so as to be configured to provide shock attenuation; and wherein the gradual taper of the built-in forefoot raised platform from 4.0 mm to 1.0 mm provides continued stability by dispersing pressure evenly toward the toe edge while ensuring the shock attenuation in the forefoot region.

* * * * *